US005575373A

United States Patent [19]

Peters

[11] Patent Number: 5,575,373

[45] Date of Patent: Nov. 19, 1996

[54] DEVICE FOR STORING MONEY IN A CAB

[76] Inventor: Hans-Jakob Peters, Dibberser Muhlenweg 71, 2110 Buchholz, Germany

[21] Appl. No.: 939,529

[22] Filed: Sep. 4, 1992

Related U.S. Application Data

[63] Continuation-in-part of PCT/EP91/00408 filed Mar. 5, 1991.

[30] Foreign Application Priority Data

Mar. 5, 1990 [DE] Germany ..... 40 06 881.1

[51] Int. Cl.[6] ..... G07B 13/02

[52] U.S. Cl. ..... 194/202; 194/206

[58] Field of Search ..... 194/206, 207, 194/209, 217, 218, 350, 202; 232/7, 12, 15, 16; 109/20, 21

[56] References Cited

U.S. PATENT DOCUMENTS

| | | | |
|---|---|---|---|
| 1,219,092 | 3/1917 | Fay . | |
| 2,950,799 | 8/1960 | Timms | 194/207 |
| 3,605,971 | 9/1971 | Forehand | 194/242 |
| 3,690,332 | 9/1974 | Dykehouse et al. . | |
| 3,834,406 | 10/1974 | James . | |
| 4,051,790 | 10/1977 | Meditz et al. | 109/58 |
| 4,249,552 | 2/1981 | Margolin et al. | 194/207 |
| 4,524,904 | 6/1985 | Masse et al. | 232/7 |
| 4,722,435 | 2/1988 | Mareels et al. | 109/25 X |
| 4,852,502 | 8/1989 | Klingsberg et al. | 109/25 |
| 4,942,831 | 7/1990 | Tel | 109/29 |

FOREIGN PATENT DOCUMENTS

| | | |
|---|---|---|
| 0190778 | 8/1986 | European Pat. Off. . |
| 0255885 | 2/1988 | European Pat. Off. . |
| 0328480 | 8/1989 | European Pat. Off. . |
| 1965103 | 7/1967 | Germany . |
| 1555952 | 10/1970 | Germany . |
| 1630984 | 8/1971 | Germany . |
| 2200892 | 7/1973 | Germany . |
| 2304127 | 8/1973 | Germany . |
| 2624510 | 12/1977 | Germany . |
| 2926153 | 1/1980 | Germany . |
| 3022794 | 3/1981 | Germany . |
| 3301069 | 7/1983 | Germany . |
| 3431205 | 5/1985 | Germany . |
| 3513635 | 10/1986 | Germany . |
| 88/05490 | 7/1988 | WIPO . |

*Primary Examiner*—F. J. Bartuska
*Attorney, Agent, or Firm*—Chilton, Alix & Van Kirk

[57] ABSTRACT

The device for storing money in a cab is distinguished by the fact that it exhibits, in a lockable housing, one or more openings for the introduction of notes and/or coins, mechanisms for dispensing notes and/or coins, mechanisms for determining the amount to be dispensed and mechanisms for invalidating at least the notes in the event of forcible tampering.

20 Claims, 1 Drawing Sheet

DEVICE FOR STORING MONEY IN A CAB

This is a continuation-in-part of copending application International Application PCT/EP91/00408 filed on Mar. 5, 1991.

Raids on cabs are a major problem. They are repeatedly taking place, since the perpetrators are able to assume that a certain sum of money is located in the cab, presumably the day's earnings obtained up to that point—unless the driver has since safely deposited these somewhere—at least, however, the change which necessarily has to be carried. This change alone is incentive enough for some perpetrators to commit the crime, especially as the opportunity is favourable, since the perpetrator is able to select the scene of the crime himself; the threshold of inhibition is also correspondingly low.

The object of the invention consists in the creation of a device by which the incentive for cab raids is eliminated.

The solution according to the invention consists in the fact that the device, in a lockable housing, exhibits one or more openings for the introduction of notes and/or coins, mechanisms for dispensing notes and/or coins, mechanisms for determining the amount to be dispensed and mechanisms for invalidating at least the notes in the event of forcible tampering.

The opportunity for unlawful enrichment through the money located in the cab represents the motive in the majority of raids. This enrichment can be achieved in two ways: by direct seizure or by tampering with the change-giving procedure. As a result of the particular configuration of the device, enrichment effected by direct seizure at least through notes—is not possible, since, by virtue of the fact that the container disposed in the device is locked and the key is not located in the cab, neither the passenger nor the driver can get to the money without forcible opening; even after forcible opening, however, the container does not expose the worth of its contents, since Just a few moments after the start of an attempt at forcible opening—or even after the detachment of the complete, still closed appliance—the money would have been invalidated by the mechanisms for invalidating the money and the perpetrator would be left with only worthless paper.

A particularly simple and hence inexpensive embodiment is distinguished by the fact that it is configured only for the introduction/issuing of notes. Although the appliance is simpler, since no devices are provided for the feed-in and dispensing of coins, which would also make the appliance larger, the essential protective purpose is achieved, since the cab driver still only has coins on him. In this instance, the issued quantity of notes cannot of course correspond precisely to the amount to be paid out. Instead, only that amount which is to be reimbursed in notes is given from this change.

In the case of an advantageous embodiment, it is designed to be configured also for the introduction/dispensing of coins, In this case, there is no longer in the cab any money which a perpetrator could procure by direct seizure.

Now the only remaining opportunity for unlawful enrichment consists solely in tampering with the change-giving procedure which necessarily has to be carried out. However, this opportunity can be rendered very unlikely or quite impossible by additional security measures, such as those described further below.

If suitable measures are now taken to ensure that there is no opportunity of a person leaving the cab with more money than he already held when entering the cab and if every passenger is familiar with this (through publicity on TV, radio, in the press, word-of-mouth propaganda, appropriate stickers, e.g. on the glovebox—the driver can also of course easily explain it to the passenger, for foreign passengers a spoken cassette in the respective language could be played back), then nobody would any longer attempt a raid in view of the futility of the venture. The advantage of this process: the crime is averted, it is not responded to; quasi a "causal therapy".

In addition to the principal benefit (the prevention of raids), a further advantage of the process lies in an increased feeling of security for the driver, particularly in relation to night journeys (hence also the elimination of stress).

The insertion of money and the subsequent dispensing of change operate as follows:

when a journey is completed, the cab driver introduces the money which has been handed to him into the device. At the same time, the device receives information stating the amount of change which is to be dispensed. There are various options for achieving this. In a simple version, a keyboard is merely provided for inputting the value of the amount to be dispensed, i.e. the amount of change. In the case of another expedient embodiment, the value of the introduced amount is input by means of a keyboard, or in the case of a particularly advantageous embodiment, is determined and conveyed by a reading appliance disposed in the device. A computer disposed in the device then determines whether the introduced amount is greater than the keyed-in amount of change to be paid out. Only when this is the case is the change paid out. In the case of a further expedient embodiment, the computer disposed in the device has the task of calculating, from the value of the introduced amount and the fare tariff, the difference between them and of then passing this value (as the value of the amount to be paid out) on to the dispensing devices.

In this connection, the fare tariff can similarly be input into the appliance by means of a keyboard or can be read off through an appropriate connecting line to the cab meter.

There follows below the description of additional security measures for preventing unlawful enrichment through tampering with the change-giving procedure.

In the case of embodiments without a reading mechanism, the issue of change and the value of the amount to be paid out can only be determined by being keyed in, i.e. without any money actually having been inserted. Here, tampering is of course possible. A perpetrator could plunder the entire contents of the device by threatening the driver. For this reason, the value of the money which can be stolen within a sensible time must here at least be limited.

For this purpose, in the case of an advantageous embodiment, it is designed so that, where there is a money-changing procedure, only a limited sum can be dispensed (e.g., DM 97.00 or DM 47.00, on the assumption that a cab journey costs at least DM 3.00), and that, up to the next money-changing, slither a certain distance has to be covered (e.g. 3 km) or a certain time (e.g. five minutes) has to pass. The appropriate controlling can be effected by a clock and/or by connection to the mileometer or cab meter.

This kind of limitation on paying out change is recommended for all appliance variants in which—at least theoretically—tampering is still possible.

However, since the possible capture of DM 97.00 (or DM 47.00) might still now represent an incentive for a raid, it would appear sensible to make the dispensing of change dependent upon a release pulse which is only triggered when the amount in question is actually fed into the device, that is to say either by the driver (who can of course see whether this is a fraud attempt), or by a mechanism recognizing at least one or more features of the introduced note (possibly also of coins).

Consequently in the case of an advantageous embodiment, it is designed to be equipped with a switch for releasing the change, which switch is located outside the device and is to be operated by the driver and the presence and function of which is not known to the passenger.

If the driver fails to actuate this switch, then the appliance does not dispense any change; to a perpetrator, this would look as if the appliance was not accepting the inserted note (or indeed the introduced coins) or (if nothing has been inserted), as if it would not pay out anything without something having been inserted.

This strategy is based therefore upon the perpetrator having no knowledge of the described connection —for otherwise he could of course force the driver to actuate the switch.

In the case of a further advantageous embodiment however, any such coercion would be fruitless, since this embodiment is equipped with a mechanism which not only fails to pass on the release pulse for the dispensing of change in the event of non-actuation, but also in the event of actuation if the driver shows indications of increased stress. Such indications would certainly arise if threats were to be made by the perpetrator and threats would inevitably be necessary since any tampering attempt would require the forced toleration or cooperation of the driver.

The mechanism comprises one or more sensors, which are able to scan parameters providing information on the driver's state of nervous excitement. As parameters, the pulse rate or the skin resistance, for example, can be considered. The skin resistance could be measured, for example, by touching a handle equipped with appropriate sensors.

In this case, therefore, the device will only dispense change if the driver indicates to it that everything is in order and he could not lie or be forced to lie in this respect (cf. "lie detector" principle). Change is only therefore dispensed if everything is really in order.

In the case of a further advantageous embodiment, the device is designed to exhibit a mechanism for identifying one or more features of the introduced notes. The checking or identification is effected by means of one or more sensors.

As features to be scanned, the following, inter alia, enter into consideration:

the approximate size of the note (scanned by sensors which merely determine whether anything at all has been inserted—the need for conformity of the approximate size is generated by the nature of the feed-in opening), the exact size of the note (this too would only require very simple sensors), the typical line pattern of the bank note in question (scanned, for example, by a light pencil), similarly the presence and position of the security stripe, or the watermark, scanned by means of a UV-source and corresponding sensor.

If now the identification mechanism simply recognizes whether something has been introduced into the feed-in opening or not, a simple release pulse is effected (or not).

If, on the other hand, one (or more) specific feature(s) are recognized, the value of the note, the feature(s) of which has/have been recognized, is conveyed to the computer disposed in the device (in this case, therefore, there is no longer any need to key in the value of the introduced amount). If, despite the presence of a reading appliance, the value of the introduced amount is keyed in from outside, then a simple release pulse is effected (or not) by the reading appliance.

Where the device is fitted with an identification mechanism of this kind, tampering with the change-giving procedure would require, in any case, the feed-in of a bill having the particular demanded feature. Since this presupposes planning or preparation, whereas cab raids generally stem from a spontaneous whim or decision, such a possibility can clearly already be largely dismissed.

Moreover, it is certainly conceivable for there to be no knowledge whatsoever about which feature is scanned by the identification mechanism, for this knowledge could remain limited to just a few persons in the manufacturing company; the driver does not ultimately need to know in order to operate the appliance. There could simply be stated the appliance recognizes the notes.

Even greater security would be offered by the combination of an identification mechanism of this kind with the above-described switch to be secretly actuated by the driver, or with the mechanism for checking nervous excitement. The dispensing of change would then depend, of course, upon the receipt of two pulses. In this case, any unlawful enrichment could also further be prevented if the perpetrator were to introduce a suitably prepared bill which the appliance would not recognize as a counterfeit.

If the device is designed to contain sensors for the identification of coins, then these could be made capable of recognizing, for example, the size and/or the weight of the coin in question.

A more complex but, in return, very secure embodiment is distinguished by the fact that it exhibits a device for checking or identifying the complete note. Such mechanisms are known and are also of only relatively small size, so that a mechanism of this kind might certainly be housed in a device disposed in a vehicle. The mechanism only emits the release pulse for the dispensing of change if a note to the appropriate value has actually been introduced. In this case, tampering might still perhaps be conceivable if a professionally counterfeited note were inserted. In that case, however, the purpose of the device would still be fulfilled, for this purpose does not of course consist in safeguarding the driver from the loss of DM 100.00, but in preventing the use of force against the driver and force would not here be necessary since a "fake" which were not recognized as such by the above-described mechanism could clearly not be recognized by the driver either, especially not in the semi-darkness of the car. If the mechanism is counterfeit-proof, then there is no longer any opportunity for unlawful enrichment through change given for notes.

An additional, suitably reliable identification element for coins, which is disposed in a further advantageous embodiment, would render the impossibility of enrichment complete.

In the case of an advantageous embodiment, it is designed to exhibit a suction device, which is connected to the motor vehicle fan on the suction side, for raising and moving the note to be paid out in the particular case. In this embodiment, the note can be sucked against a plate or the like, by which it is then fed to the delivery opening, the vacuum being generated by the fan which is anyway located in the vehicle.

The appliance can additionally be designed to re-eject a note if it is unable to change it; or also when it recognizes the note as counterfeit. Money can also of course be inserted at any time in order to replenish the store of change. The largest note in each case (i.e. the hundred mark note, for example) cannot be paid out at all.

In the case of an advantageous embodiment, the compartment for storing notes is designed to exhibit a plurality of movable floors. Due to these movable floors, the insertion and removal of notes of one sort can thereby be facilitated, since the interspace between these floors can be enlarged. At the same time, only the total number of notes to be taken up is limited. The case cannot arise whereby, for example, the compartment for the 20 DM notes is overfilled, whilst the compartments for the other notes are still almost empty. Moreover, better utilization of the available space enables the appliance to be made smaller overall.

In the case of an advantageous embodiment, the mechanism for invalidating the notes is designed to consist of a device which cuts up the notes, that is to say such that a round hole is produced by a suitably shaped tubular borer, which is guided in this instance through the dividing floors between the individual note compartments (which are there provided with corresponding holes). The mechanism is triggered whenever the appliance is forcibly tampered with. A triggering could be effected, for example, if a wire which is laid around the appliance or in it such that it is bound to break in the event of forcible opening, is interrupted. The wire additionally connects the appliance to the car, so that if the complete, still closed appliance is stolen, the same effect occurs. Where necessary, the appliance can contain a small internal battery enabling the borer to function even if the device is separated from the vehicle battery or even, indeed, if the appliance is switched off.

The invalidation of the money could also be effected by covering it with a non-removable ink, acid, oil, sticky liquid (particularly suitable for coins) or the like.

A further advantageous embodiment is distinguished by the fact that it is connected to an alarm mechanism. Whenever the device is tampered with, the control room for example, in the case of radio cabs, could be notified, or the vehicle horn and the vehicle indicators could be switched on. This too should be known in advance, for the purpose is as a deterrent, not as an investigation aid.

A further advantageous embodiment is distinguished by the fact that it exhibits a change-store display device, the trip button or switch-on button for which, however, should remain as well concealed as possible.

DETAILED DESCRIPTION OF THE INVENTION

Figure 1:
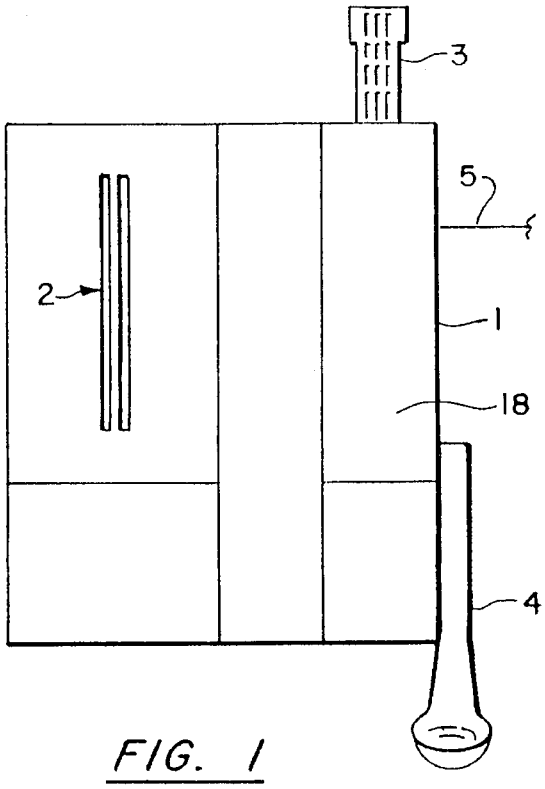
FIG. 1 shows a frontal view of the device.
Figure 2:
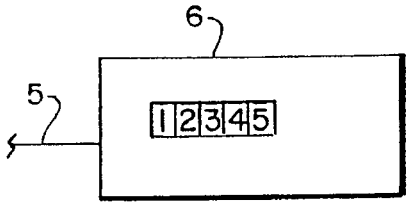
FIG. 2 shows the taximeter.

Referring now to the drawings, in particular FIGS. 1 and 2, device 1 has an input and output slot 2 for bills, input slots 3 for various coins and an output 4 for coins. There is provided a control connection 5 to the taximeter 6.

Figure 3:
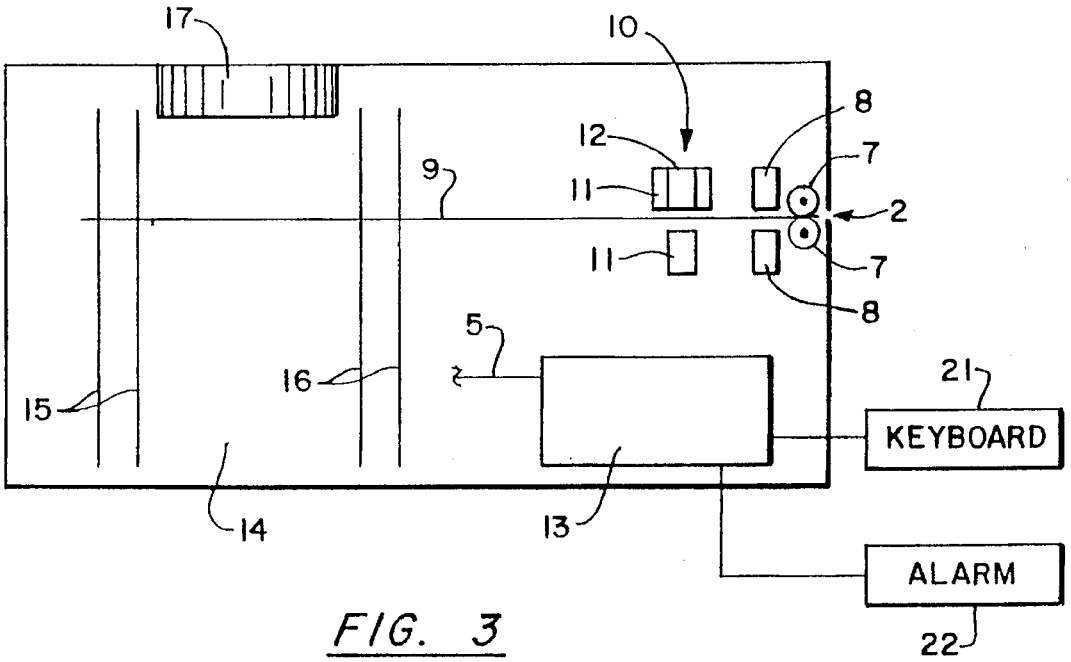
FIG. 3 shows a sectional view of the device.

As shown in FIG. 3, the input and output slot 2 is provided with a pair of rolls 7 which convey the bills into the device or out of it. Behind the pair of rolls 7 a bill entering the device passes a clamping unit 8 which provides the bill with one or more clamps which are guided along a guiding path 9. After the clamping unit 8 the bill passes an identifying or scanning unit 10 which contains light sources 11 and a series of sensors 12. The signals of the scanning sensors 12 are communicated to a control unit 13.

Thereafter the bills are conveyed to the storing unit 14 which has rails 15, 16 to receive the clamps which guide each bill. The bills, each held by clamps, are stacked in the storing unit 14.

In addition to the storing unit 14 a destroying unit 17 is included, which, after having been activated by an alarm signal from an alarm 22, sends the destroying element through the storing unit, thereby piercing or cutting into pieces or otherwise destroying the bills.

There is also a container 18 for coins which need not be illustrated in detail because it is well known in the art. It contains means for receiving the coins separately and for issuing them in case of corresponding issue signals. Also the coin input device 3 contains an identifying unit or at least a counting unit which communicates the coin input to the control unit 13.

The control unit 13 is arranged to evaluate the signals received from the scanning unit 10. If it receives unknown signals, the input is rejected and the conveying means carrying the bill are reversed in order to return the bill. If the control unit 13 "knows" a bill, the bill is stacked in the storing unit 14 and the control unit remembers the storing order. It compares the input with the amount due which can be derived from the taximeter device 6, or another suitable device for registering the amount due, such as a keyboard 21, connected to the control unit 13, upon which the amount due can be entered, and calculates the difference to be returned.

The control unit now calculates how and whether the amount to be returned can be composed from individual bills and coins stored and activates the conveyors for the bills and the coin release.

As will be apparent to persons skilled in the art, various modifications and adaptations of the structure above described will become readily apparent without departure from the spirit and scope of the invention, the scope of which is defined in the appended claims.

I claim:

1. A device for storing money in a cab comprising:

a lockable housing for holding notes, the housing having at least one note opening for receiving at least one note, note identifying means for determining the value of the at least one note which is received through the note opening in the housing, means for dispensing change in an amount having a value which is no more than the value of the at least one note which is received in the housing, means for invalidating the notes held in the housing in the event of forcible tampering, and means for connecting the device to a cab meter.

2. A device according to claim 1, wherein the means for dispensing change includes a switch for releasing change.

3. A device according to claim 1, further including an alarm which is activated by tampering with the device.

4. A device according to claim 1, further including means for displaying the store of change.

5. A device according to claim 1, further including lock means for preventing the cab driver from removing notes from the housing by any manner other than through the means for dispensing change.

6. A device according to claim 1, wherein the housing further includes means for holding coins, at least one coin opening for the introduction of at least one coin into the housing, and coin identifying means for determining the value of the at least one coin which is received through the coin opening in the housing.

7. A device according to claim 6, further including means for determining the value of the at least one coin which is introduced.

8. A device according to claim 1, further including registering means for registering an amount to be retained in the housing.

9. A device according to claim 1, wherein the means for invalidating the notes includes means for boring holes in the notes.

10. A device according to claim 1, wherein the registering means includes a keyboard.

11. A device according to claim 1, further including means for calculating the amount of change to be dispensed.

12. A device according to claim 1, wherein the means for dispensing change includes means for dispensing coins.

13. A device for storing money in a cab, comprising:

a lockable housing for holding notes, the housing having at least one note opening for receiving at least one note, note identifying means for determining the value of the at least one note which is received through the note opening in the housing, means for dispensing change in an amount having a value which is no more than the value of the at least one note which is received in the housing, the means for dispensing change including means for dispensing only a limited amount of change per unit of time, and means for invalidating the notes held in the housing in the event of forcible tampering.

14. A device according to claim 13, further including means for calculating the amount of change to be dispensed.

15. A device according to claim 13, wherein the means for dispensing change includes means for dispensing coins.

16. A device for storing money in a cab, comprising:

a lockable housing for holding notes, the housing having at least one note opening for receiving at least one note, note identifying means for determining the value of the at least one note which is received through the note opening in the housing, means for dispensing change in an amount having a value which is no more than the value of the at least one note which is received in the housing, the means for dispensing change including means for dispensing only a limited amount of change per distance travelled, and means for invalidating the notes held in the housing in the event of forcible tampering.

17. A device according to claim 16, further including means for calculating the amount of change to be dispensed.

18. A device according to claim 16, wherein the means for dispensing change includes means for dispensing coins.

19. A device according to claim 16, further including registering means for registering an amount to be retained in the housing.

20. A device according to claim 16, wherein the means for invalidating the notes includes means for boring holes in the notes.

* * * * *